US008261381B2

(12) United States Patent
Hallock et al.

(10) Patent No.: US 8,261,381 B2
(45) Date of Patent: Sep. 11, 2012

(54) SAFETY BED FRAME MOUNTING SYSTEM

(75) Inventors: Joseph H. Hallock, Boones Mill, VA (US); Gregg Weinschreider, Rocky Mount, VA (US)

(73) Assignee: Sleep Safe Beds, LLC, Callaway, VA (US)

( * ) Notice: Subject to any disclaimer, the term of this patent is extended or adjusted under 35 U.S.C. 154(b) by 353 days.

(21) Appl. No.: 12/728,807

(22) Filed: Mar. 22, 2010

(65) Prior Publication Data

US 2010/0199431 A1 Aug. 12, 2010

Related U.S. Application Data

(63) Continuation-in-part of application No. 11/857,263, filed on Sep. 18, 2007, now Pat. No. 7,681,260.

(60) Provisional application No. 60/845,476, filed on Sep. 18, 2006.

(51) Int. Cl.

| | |
|---|---|
| ***A61G 7/012*** | (2006.01) |
| ***A61G 7/05*** | (2006.01) |
| ***A61G 7/015*** | (2006.01) |
| ***A47C 21/08*** | (2006.01) |

(52) U.S. Cl. ..... 5/611; 5/425; 5/424; 5/613

(58) Field of Classification Search ..... 5/425, 424, 5/428, 430, 100, 611, 11, 610, 613, 600
See application file for complete search history.

(56) References Cited

U.S. PATENT DOCUMENTS

| | | | |
|---|---|---|---|
| 321,649 | A | 7/1885 | Shelley |
| 2,478,028 | A | 8/1949 | Travis |
| 2,651,785 | A | 9/1953 | Berner |
| 3,093,838 | A | 6/1963 | Beasley |
| 3,373,453 | A | 3/1968 | Goodman |
| 3,686,696 | A | 8/1972 | Lanigan |
| 3,763,507 | A | 10/1973 | Propst |
| 3,780,387 | A | 12/1973 | Propst |
| 4,227,269 | A | 10/1980 | Johnston |
| 4,345,344 | A | 8/1982 | Gadoury et al. |
| 4,398,313 | A | 8/1983 | Mitchell |
| 4,425,673 | A | 1/1984 | Werner |
| 4,675,926 | A | 6/1987 | Lindblom et al. |
| 4,715,074 | A | 12/1987 | Wallace et al. |
| 4,793,428 | A | 12/1988 | Swersey |
| 4,811,436 | A | 3/1989 | Schwartz |
| 4,868,937 | A | 9/1989 | Connolly |
| 4,953,244 | A | 9/1990 | Koerber, Sr. et al. |

(Continued)

FOREIGN PATENT DOCUMENTS

FR 2726982 A 5/1996

*Primary Examiner* — Robert G Santos
(74) *Attorney, Agent, or Firm* — Charles S. Sara, Esq.; DeWitt Ross & Stevens, S.C.

(57) ABSTRACT

A safety bed including a bed frame with a head board, side boards and a footboard, pivotally attached guard members, and a vertically adjustable mattress support structure which is attached to the side boards. The mattress support structure is capable of being lowered within the confines of the bed frame to prevent a patient from crawling out of the safety bed. The mattress support structure capable of being raised within the bed frame to grant a health care provider access to the patient. The raising and lowering of the mattress support frame does not affect height of the side boards or guard members.

19 Claims, 8 Drawing Sheets

U.S. PATENT DOCUMENTS

| | | | |
|---|---|---|---|
| 4,974,692 | A | 12/1990 | Carruth et al. |
| 4,979,246 | A | 12/1990 | Godin et al. |
| 5,033,563 | A | 7/1991 | Brainerd, Jr. et al. |
| 5,384,925 | A | 1/1995 | Vail |
| 5,742,959 | A | 4/1998 | Froelich |
| 5,926,870 | A | 7/1999 | Branca-Barnes |
| 6,216,291 | B1 | 4/2001 | Eads et al. |
| 6,453,491 | B1 | 9/2002 | Wells et al. |
| 6,487,735 | B1 | 12/2002 | Jacques, II et al. |
| 6,516,478 | B2 | 2/2003 | Cook et al. |
| 6,687,930 | B1 | 2/2004 | Eads et al. |
| 6,694,547 | B1 | 2/2004 | Vail |
| 6,772,458 | B2 | 8/2004 | Ellen et al. |
| 7,076,817 | B1 | 7/2006 | Garver |
| 7,415,740 | B1 | 8/2008 | Kemper |
| 7,430,770 | B2 | 10/2008 | Ramirez |
| 7,681,260 | B2 | 3/2010 | Hallock et al. |
| 2003/0135923 | A1 | 7/2003 | Godin et al. |
| 2006/0162070 | A1 | 7/2006 | Lawlor et al. |
| 2008/0066230 | A1* | 3/2008 | Hallock et al. ..... 5/600 |
| 2010/0199431 | A1* | 8/2010 | Hallock et al. ..... 5/611 |

* cited by examiner

SAFETY BED FRAME MOUNTING SYSTEM

REFERENCE TO RELATED APPLICATION

The application is a continuation-in-part application and claims priority to U.S. patent application entitled "SAFETY BED HAVING ELEVATING MATTRESS," Ser. No. 11/857,263, filed Sep. 18, 2007, now U.S. Pat. No. 7,681,260 which claims priority to U.S. Provisional Application 60/845,476, filed Sep. 18, 2006, both of which are incorporated herein by reference in their entirety.

FIELD OF THE INVENTION

The present invention is directed to a safety bed primarily for use in care for patients with physical and developmental disabilities where special circumstances require a bed designed to reduce the possibility of injury to the patient. Specifically, a bed is required which would prevent falls and entrapment for individuals who need care.

DESCRIPTION OF THE PRIOR ART

Safety beds are well known and described in the field, such as those which are commonly found in certain medical and geriatric facilities. Generally, these beds include a guard member assembly which can be raised to prevent the patient from falling out of the bed and lowered to allow the patient ingress and egress from the bed. Known guard member assemblies, such as those described in U.S. Pat. No. 5,742,959, typically include a top and a bottom horizontal member as well as a series of spaced vertical bars there between. Such assemblies are therefore a lattice type of structure having a number of associated gaps. Other safety or guard member assemblies for cribs, such as described in U.S. Pat. No. 5,926,870, have similarly "gapped" structures.

In spite of fairly strict governmental standards that have been specifically mandated for the construction of safety beds, there have been numerous reported instances in which a patient has fallen not only through gaps in a guard member assembly, but also between other gaps often created between the lateral side of the mattress and box spring and the guard member assembly, and between various portions of the bed frame itself. These injuries can not only be traumatic but also catastrophic, producing entrapment and possibly death. Therefore, there is an urgent need in the field to provide a safety bed which all but eliminates the probability of such injuries as those described above.

Reference is specifically made to U.S. Pat. No. 6,453,491 to Wells et al. which describes a safety bed having a releasable guard member assembly. The guard member assembly includes at least one guard member sized to extend over an entire lateral side of the frame of the bed. In addition, there is a means for releasably attaching the guard member to the bed frame. The means includes a hinge for attaching the lower end of the guard member to the bed frame. The guard member can then be selectively pivotally moved between a first raised position and a second lowered position. When the guard member is in the first position, the guard member is in compressive contact with a lateral side of the mattress to minimize the existence of gaps between the bed frame, the guard member, and the mattress. When the guard member is in the second position, the guard member permits a patient ingress and egress from the bed. When the guard member is secured in the first position the patient is prevented from falling out of the bed. At the same time, the guard member also prevents or at least substantially minimizes the incidences of gap-related injuries which can occur using standard known guard member assemblies.

Although safety beds have been improved to prevent entrapment of a patient between the mattress and the side board, none of the prior art has addressed the problem of patients crawling out of the bed. A restless patient can easily climb over top of the side boards and potentially fall to the floor. Potential solutions to this problem are included in U.S. Pat. No. 5,926,870, which includes unusually high end and side panels. The high end and side panels create a higher barrier, which is harder for the patient to climb over. A similar solution has been proposed in U.S. Pat. No. 4,811,436, which creates a higher barrier for a patient. The design of these two patents places the patient in a fixed location and with the side boards up, out of reach of the health practitioner. In order to access the patient, the health practitioner must fold down the guard member and likely bend over to reach the patient. These designs both create an uncomfortable work environment for the practitioner, as well as a potential safety risk for the patient.

A safety bed should not only attend to the patient's needs, but also create a more efficient work space for the health practitioner. A safety bed should combine the safe enclosure of high side walls for the patient, as well as a high mattress position to assist the health practitioner. Therefore, a need exists to combine safety features for the patient and assist the practitioner in caring for the patient.

SUMMARY OF THE INVENTION

The present invention is directed to a safety bed for patients with physical and developmental disabilities. The safety bed comprises a bed frame of substantially rigid construction to prevent gaps from forming between the bed frame and a mattress positioned within the bed frame. The bed frame includes a headboard, a footboard, and a pair of opposing side boards which interconnect the headboard and the footboard. Disposed within the bed frame is a mattress support frame that is connected to the pair of opposing side boards for supporting the mattress and for independently raising and lowering the mattress within the bed frame without causing any corresponding vertical movement on the part of the headboard, footboard and pair of opposing side boards. The headboard and footboard extend below the mattress and the mattress is in compressive contact within the bed frame such that there are no gaps between the mattress and the bed frame.

The present invention is also directed to a safety bed which comprises a bed frame of substantially rigid construction to prevent gaps from forming between the bed frame and a mattress positioned within the bed frame. The bed frame includes a headboard, a footboard, and a pair of opposing side boards which interconnect the headboard and the footboard. In addition, a mattress support frame is connected to the pair of opposing side boards and is disposed within the bed frame for supporting the mattress for independently raising and lowering the mattress within the bed frame without causing any corresponding vertical movement on the part of the headboard, footboard and pair of opposing side boards. The headboard and footboard extend below the mattress and the mattress is in compressive contact within the bed frame such that there are no gaps between the mattress and the bed frame. Further, the safety bed includes at least one pair of rotatable guard members disposed on an opposing lateral side of the bed frame. The guard members are sized to occupy the entirety of the lateral space between the footboard and the headboard such that there are no gaps between the guard members, the footboard and the headboard.

The primary patentable feature is the combination of the safety bed described in the '491 patent to Wells et al. and the adjustable (hi-lo) feature allowing for the electronic elevation and lowering of the mattress within the safety bed. The bed of the present invention allows seamless, remote control high and low mattress adjustment without any movement of the bed frame. In other words, the mattress support frame can be raised and lowered within the bed frame without any corresponding movement on the part of the side boards, headboard or footboard of the bed frame. Further advantages of the present invention include an adjustable mattress height. The mattress height, surface-to-floor, can be remotely controlled and be positioned at any height from 17 inches to 34 inches; thus, allowing for more comfort for the user and the caregiver. The adjustable mattress height allows the distance from the surface of the mattress to the top of the safety rail to be varied from 1 inch to 36 inches, preferably 8 inches to 25 inches. Varying the height of the mattress within the frame does not compromise the geometry of the bed and frame and maintains the minimal gaps between frame and mattress throughout the full range of motion. The articulated mobility of the mattress easily allows for the raising of the back portion and/or knee portion. The bed frame includes adaptable, full-length safety rails that combine the strength of solid wood with clear non-breakable plastic or polyethylene terepthalate glycol (PETG) panels.

The bed includes a rigid construction with a high-low bed frame, which utilizes tubular steel or aluminum, preferably the lighter weight aluminum, to maximize strength and stability of the sleep surface in all positions. The present invention includes a full-electric hand-held remote operation that uses ultra whisper quiet, rapid-moving DC motors. Preferably, the motor has a dynamic operating capacity of 400 pounds and meets all necessary UNDERWRITER LABORATORY (UL) safety standards for medical beds. The present invention helps the patient because caregivers have full view for easy monitoring. The bed's user can see his environment, thus reducing the chance of claustrophobia and encouraging a comfortable rest. The headboard and footboard extend below the mattress and box spring reducing the risk of entrapping an arm and leg.

The advantage of the safety bed of the present invention is that not only is it visually appealing, but it also addresses safety issues in a variety of ways, including providing clear windows incorporated in the safety rails to prevent the opportunity for entanglement in contrast to traditional institutional beds. The present invention also virtually eliminates entrapment issues. The space between side boards, headboard and footboard is nearly nonexistent even with compression. The aesthetics and hardwood construction of the bed promote a "homey" atmosphere for the benefit of not only the resident whose self-esteem may be an issue, but also for family members and caregivers who appreciate a more normalized setting.

Another advantage of the present invention is that the guard member when secured in the first position will prevent the patient from falling out of the bed, while also preventing or at least substantially minimizing the incidence of "gap-related" injuries, which can occur using standard guard rail assemblies. The present guard rail adapter and the safety bed using the adapter are in compliance with the strict governmental standards which are required for facility safety beds.

A further advantage of the present invention is that the guard member is easily movable between the first and second position for a caregiver, but not for the patient. In addition, the adapter can be adapted to be removed from the bed frame without requiring tools or intensive labor or modifications.

In addition, no part of the mattress support structure touches the ground as it is attached to the side boards of the bed frame. This facilitates easier movement of the bed from one location to another.

It is also within the scope of the present invention to include a second or upper guard member on each side of the safety bed. With the addition of the upper guard member, the height of the entire bed and frame can be increased, while the mattress can still be raised and lowered as in the single guard rail safety bed. By adding an upper guard member and increasing the overall height of the bed, the patient is more fully enclosed inside the bed frame. The extra height of the bed frame creates a safe enclosure for a taller patient, who may be able to crawl out of a lower safety bed, with only a single guard member assembly.

The objects and advantages of the invention will appear more fully from the following detailed description of the preferred embodiment of the invention made in conjunction with the accompanying drawings.

DETAILED DESCRIPTION OF THE INVENTION

The following description relates to a safety bed design according to a specific embodiment. It will be readily apparent from the following discussion, however, that certain variations and modifications can easily be imagined within the inventive concepts as claimed herein. Furthermore, certain terms are used throughout this discussion such as "upper," "lower," "lateral" and the like which assist in providing a frame of reference with regard to the accompanying drawings. These terms, however, should not necessarily be construed as limiting of the present invention, except as otherwise stated herein.

Figure 1:
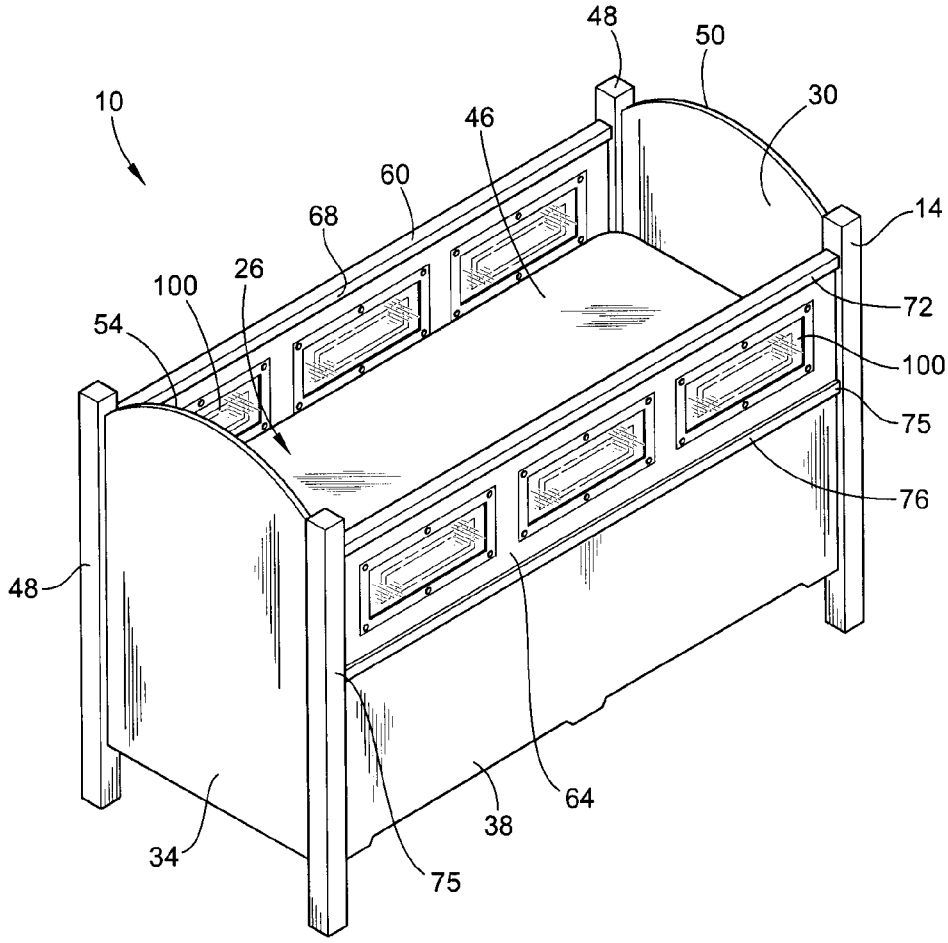
FIG. 1 is a top-perspective illustration of the safety bed with a single guard member assembly and the mattress in the upper position.

Referring to FIG. 1, there is illustrated a safety bed 10, with the mattress 26 in the upper position in accordance with the preferred embodiment of present invention. The safety bed includes a wooden bed frame 14, the frame including a headboard 30, a footboard 34, and a pair of side boards 38 (only one of which is shown in FIG. 1), which interconnect the headboard 30 and the footboard 34. The bed frame 14 and each of the preceding components collectively define a supporting structure for a stacked mattress 26 and box spring (not shown). Each of the headboard 30 and footboard 34 extend above an upper surface 46 of the mattress 26, the headboard 30 and footboard 34 each including a pair of bed posts 48 which are secured to a unitary member 50, 54, respectively, the posts being secured thereto using conventional furniture fastening techniques, such as a knockdown fitting having an eccentric cam so as to reduce forward play in each of the interconnected components.

Figure 2:
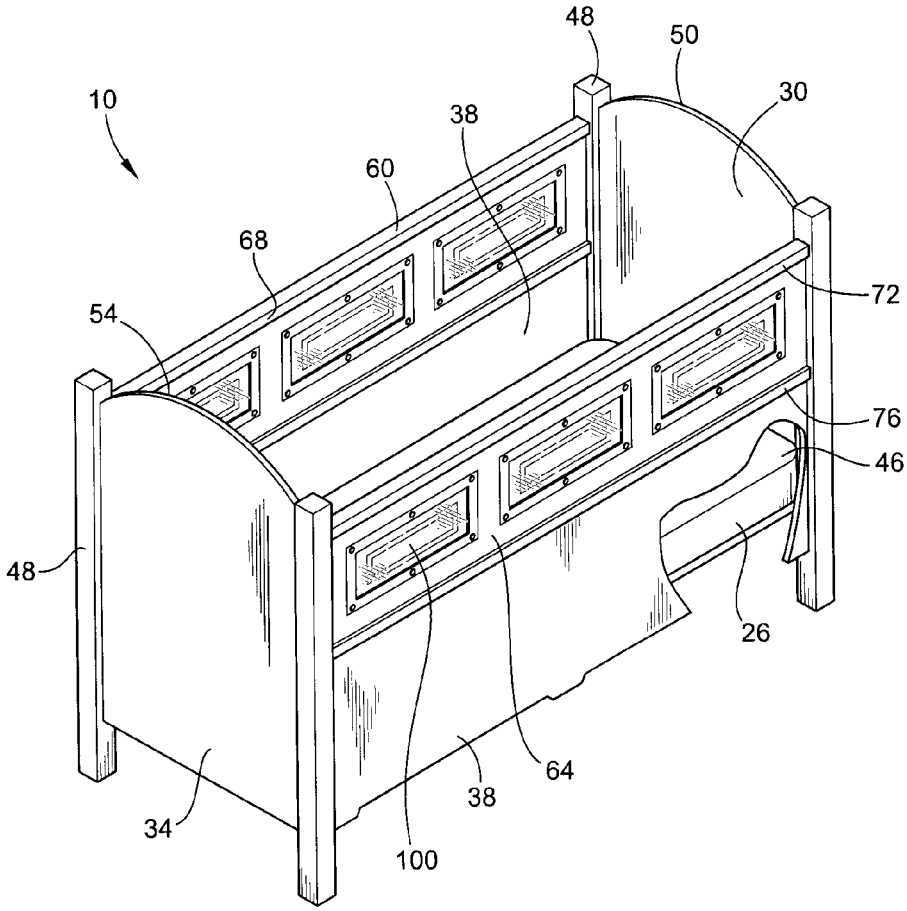
FIG. 2 is a top-perspective illustration of the safety bed with a single guard member assembly and the mattress in the lower position, which is visible in the cut-away.

Referring to FIGS. 1 and 2, a guard member adapter 60 according to the preferred embodiment includes a pair of guard members 64, 68, each of the guard members being disposed on an opposing lateral side of the bed frame 14. For purposes of the discussion which follows, only details specific to one of the guard members 64 are provided, though it should be understood that the remaining guard member 68 is identical in appearance and function.

More specifically, and referring to FIGS. 1-6, the guard member 64 includes an upper end 72 and a lower end 76. The guard members 64 are substantially planar members made from wood having a grain preferably like that of the bed frame 14. Each guard member 64 is sized to occupy the entirety of the lateral space between the footboard 34 and the headboard 30; that is, the length of a side board 38 without any gaps there between.

Figure 3:
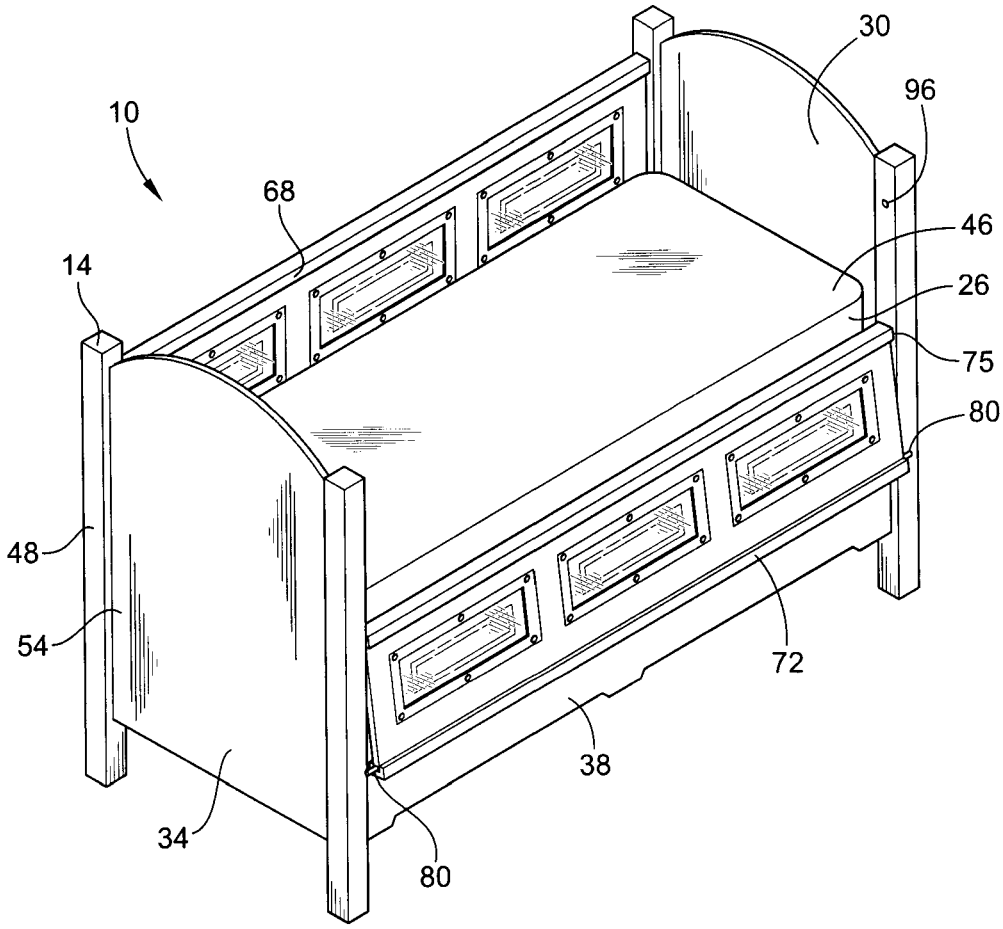
FIG. 3 is a top-perspective illustration of the safety bed with a single guard member assembly and the mattress in the upper position. The guard member assembly is in the lowered position.

The guard member 64 has a corresponding height dimension such that the upper end 72 of the member can pivot about the lower end 76 between a first or raised position, such as shown in FIG. 1, and a second or lowered position, such as shown in FIG. 3. The axis defining the pivot axis of the lower end 76 is stationary throughout the pivoting action, this axis always being beneath the upper surface 46 of the mattress 26. Each of the first and second positions assumable by the guard member 64 as shown in FIGS. 1 and 3, respectively, are substantially in the same lateral plane as the side board 38.

Each of the guard members 64, 68 include a set of preferably unbreakable transparent windows 100 made from PLEXIGLAS, polycarbonate, PETG or other suitable material, the windows being disposed between the upper and lower ends 72, 76, and permitting a caregiver to monitor a resting patient from a sitting position without having to first look over the guard member 64. Though three windows are shown, any number of windows can be provided; for example, a single window (not shown) extending over the length of the guard member 64 could be substituted.

Referring to the figures in general and in operation, the guard member 64 is attached to the bed frame 14 and in the first position assumed in FIG. 1. In this raised position, the patient (not shown) cannot fall out of the bed in that the upper end 72 of the guard member 64 is substantially above the upper surface 46 of the mattress 26. Furthermore, because the guard member 64 extends along the entire lateral side of the bed frame 14 and includes no gaps, either within the guard member itself or between the lateral side of the mattress 26 and the guard member 64, the risk of injury is greatly minimized.

Retraction of each of the locking members 80 located at the upper end 72 of the guard member adapter 60 is accomplished by pulling each of the levers 90 against the bias of springs 88 and placing the lever 90 within respective unlocked slot positions 94, thereby releasing the upper end and permits the guard member 64 to pivot downwardly about the lower end 76 from the first position, shown in FIG. 1, to the second position, as shown in FIG. 3. In this lowered position, the patient (not shown) can easily get into and out of the bed as needed.

The guard members 64, 68 can be permanently, albeit rotatably attached to the bedposts 48 of both the headboard 30 and the footboard 34 at location 75 by means of a locking pin (not illustrated) which joins the guard members 64, 68 to the bedposts 48 in rotatable fashion.

Figure 4:
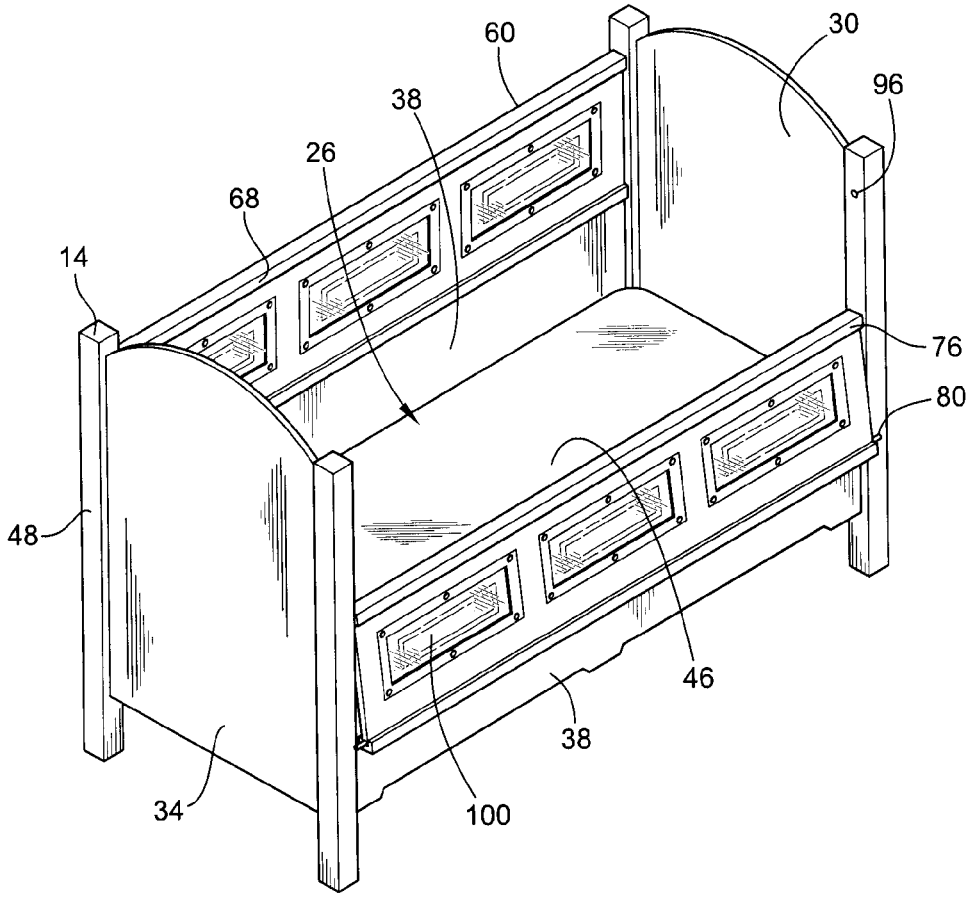
FIG. 4 is a top-perspective illustration of the safety bed with a single guard member assembly and the mattress in the lower position, which is visible in the cut-away. The guard member assembly is in the lowered position.

Alternatively, the guard members 64, 68 can be removably attached to the bed frame 14. In order to remove the guard member adapter 60 from the bed frame 14 from the first position, as shown in FIGS. 1 and 2, the guard member 64 is first pivoted to the second position, as shown in FIGS. 3 and 4, as described above, by releasing the locking members 80 at each opposing side of the upper end 72. Once the member 64 has been pivoted, the locking members 80 at the lower end 76 of the guard member 64 can also be retracted in a similar manner by pulling each of the levers 90 against the biasing of springs 88 to unlock the lower end and remove the guard member from the bed frame 14. Though not shown, guard member 68 can be similarly removed. As noted and upon removal of the guard member adapter 60, the safety bed 10 looks no different than a standard twin size bed and can be used for that purpose.

Additionally, FIG. 1 shows the mattress 26 in the raised position, and close to the top of the bed frame 14. In the raised position, a patient lying on the mattress 26 can easily be attended to by a health practitioner. The transparent windows 100 in the guard members 64, 68 allow the patient to look out into the environment. With the guard member 64 in the upper position, the patient is still safely enclosed in the safety bed 10. If the practitioner needs to have better access to the patient, the guard member 72 can be lowered as shown in FIG. 3.

Referring to FIG. 2, the mattress 26 can be lowered within the confines of the bed frame 14, so that the upper surface of the mattress 46 is well below the top of the guard members 64, 68. With the mattress 26 in the lowered position, the patient is safely held within the walls of the safety bed 10. The windows 100 in the guard members 64, 68 allow light into the safety bed 10, even when the mattress 26 is in the lowered position. This adds to the comfort of the patient. As shown in FIG. 4, a health provider can still access the patient when the mattress 26 is in the lowered position. The guard member 64 can be lowered to allow greater access to the patient. However, even when the guard member 64 is lowered, the top of the mattress 46 is still below the lower end 76 of the guard member 64. Even when the mattress 26 is in the lowered position, there is still a significant barrier for the patient to escape from the safety bed 10.

Figure 5:
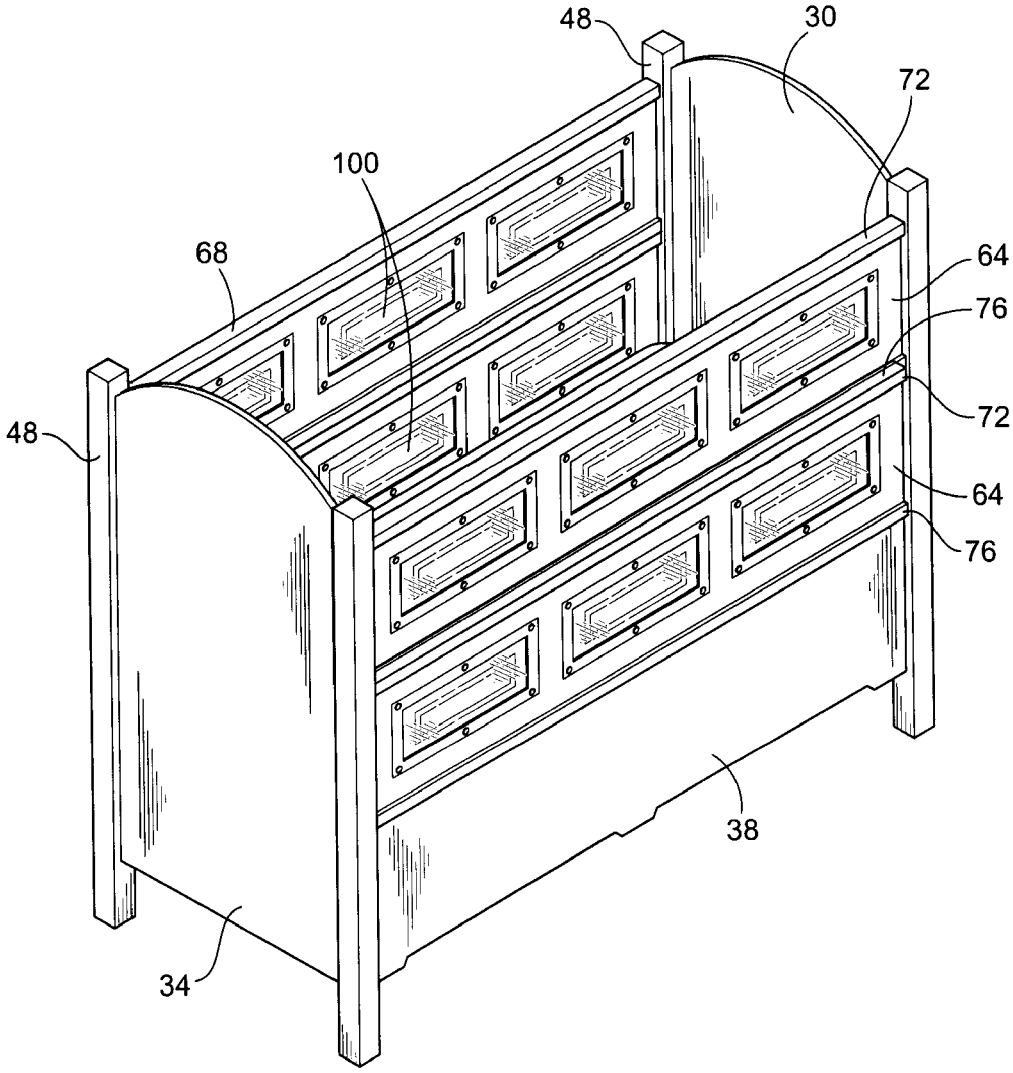
FIG. 5 is a top-perspective illustration of the safety bed with a double guard member assembly.
Figure 6:
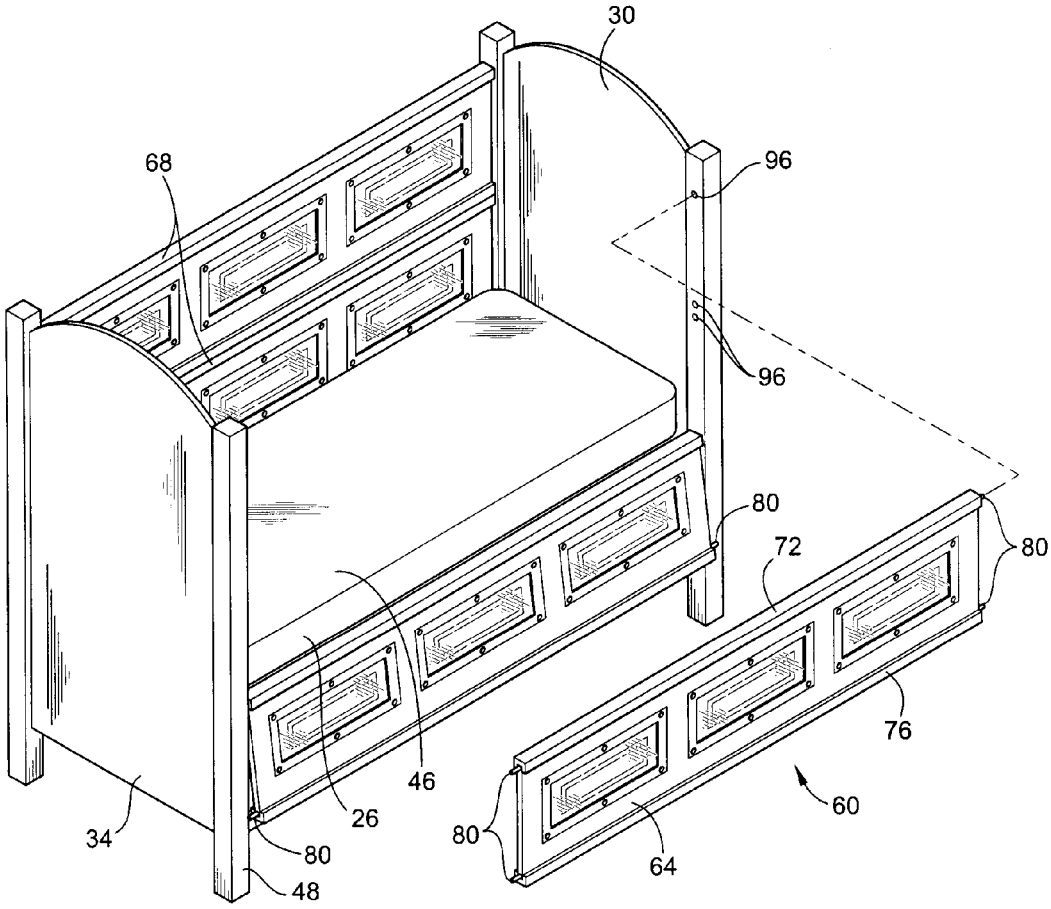
FIG. 6 is a top-perspective illustration of the safety bed with a double guard rail assembly. The upper guard rail assembly is detached and the lower guard rail assembly is folded down.

The second embodiment of the present invention is shown in FIG. 5. The second embodiment includes a double set of guard members 64, 68 on each side of the safety bed 10. The addition of double guard members 64, 68 increases the overall height of the bed frame 48, and is appropriate for taller patients. When the mattress 26 is in the lowered position, even a patient of significant height will be safely enclosed in the safety bed 10. In order to access the patient, the mattress 26 can be raised and the guard members either removed and/or lowered.

Figure 7:
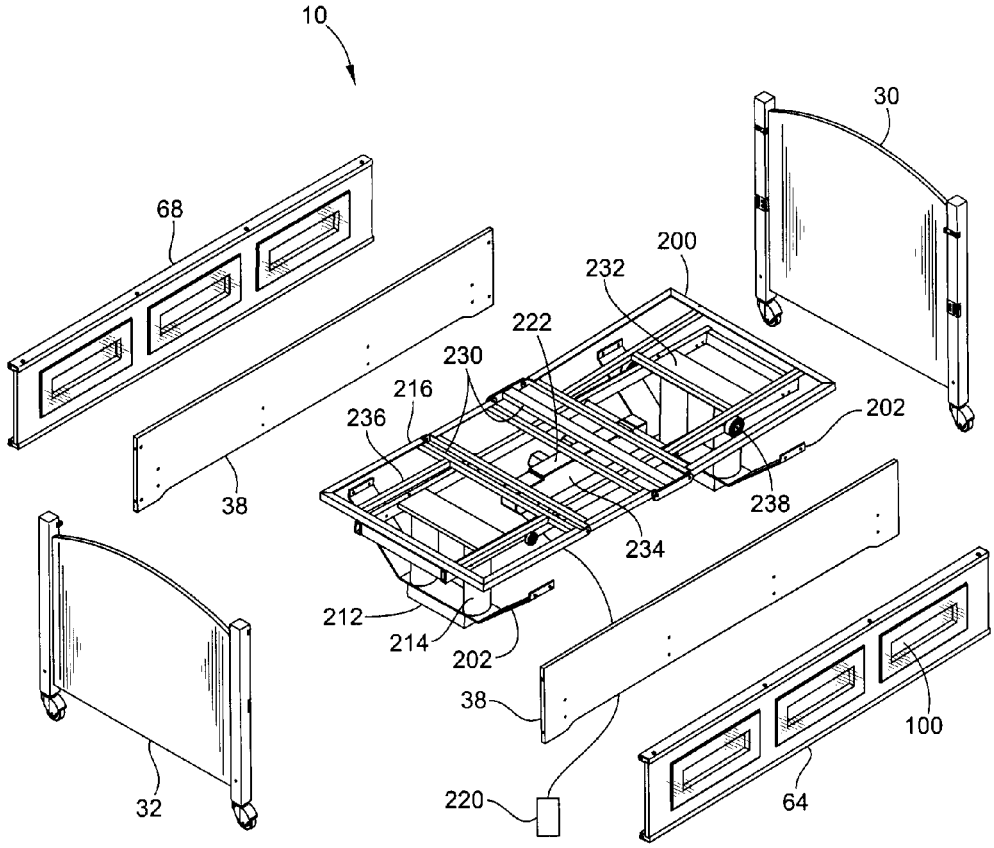
FIG. 7 is an exploded, perspective, view of the safety bed of the present invention illustrating the mechanism by which the mattress is raised and lowered, and by which the mattress is actuated.
Figure 8:
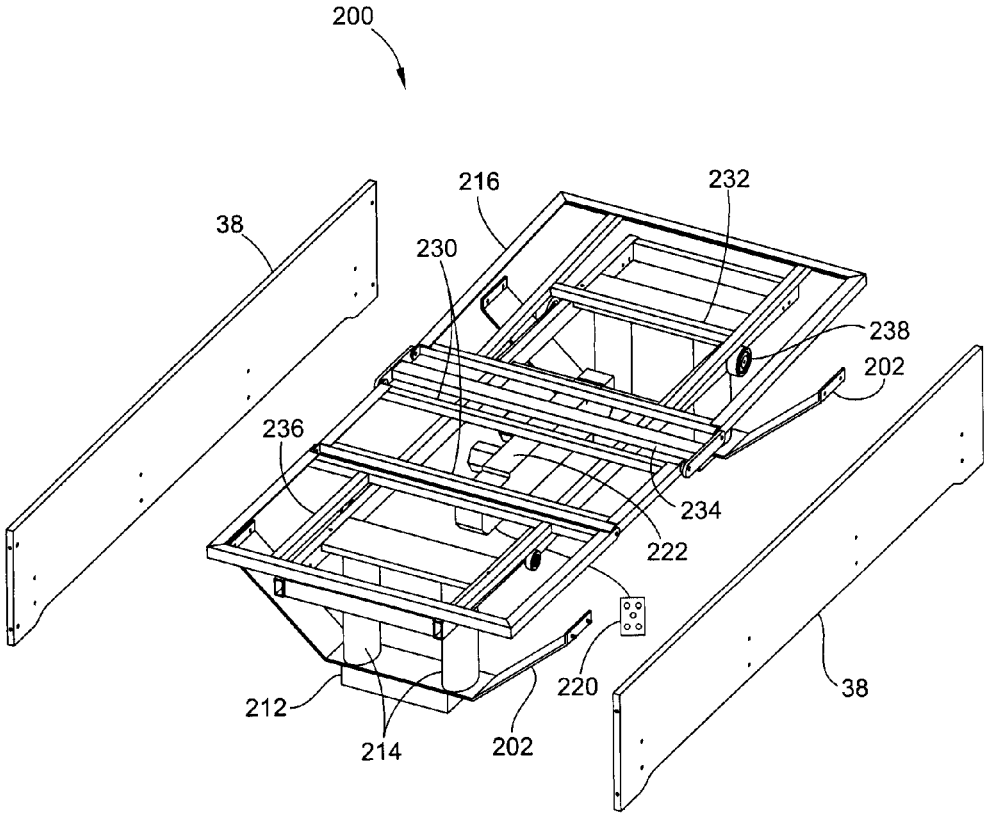
FIG. 8 is an exploded, perspective, partial view of the safety bed of the present invention illustrating the mattress support structure between the two parallel opposing side boards of the bed frame.

Referring now to FIG. 7, the mattress support structure 200 is illustrated. The mattress support structure 200 is supported by support brackets 202 which attach to the pair of side boards 38 by bolts or other means known to art and suspend the mattress support structure 200 within the bed frame 14. The mattress support structure 200 is preferably made of tubular steel or aluminum to maximize the strength and stability of the sleep surface in all positions. Referring to FIG. 8, the lower substructure 212 which is illustrated as a pair of tubular posts 214 remains fixed on top of the support brackets 202. The upper substructure 216 is connected above the lower substructure 212 by telescoping columns (not illustrated) actuated electrically within the tubular posts 214. The electric motor 222 is controlled by a remote control 220. The action of raising and lowering the mattress support structure 200 is well known to art and can include any of a number of electronic, pneumatic or other types of elevating mechanisms. Reference is made to the OKIMAT and DUOMAT line of bedding motors produced by OKIN America LLC (Shannon, Miss.) and actuators produced by Precision Technology, Inc. (Roanoke, Va.) for an example of a suitable mechanism for use here. It is within the scope of this invention to use additional mechanisms to accomplish the same task. Additionally, although a column elevation system 214 is shown, other linkages such as a parallelogram or scissor linkage could also be used.

As shown in FIGS. 7 and 8, the mattress support structure 200 has articulating joints 230 which separate the head section 202, the thigh section 204, and the foot section 206. The articulating joints 230 allow the head section 232, thigh section 234 and foot section 236 to raise and lower independently. This allows for greater patient comfort. The remote control 220 can control additional DC motors (not illustrated) to operate actuating pistons 235 to raise and lower the sections 232, 234, and 236.

In operation, the electric motor 222 is plugged into a standard wall outlet by an electric cord (not illustrated). The upper substructure 216 of the mattress support structure 200 is operated typically using a corded remote control 220. It is also within the scope of the present invention to provide a backup battery system (not illustrated) in the event of a power outage. For example, the mattress support structure 200 can be provided with a 9 volt backup battery designed to allow the operator to lower the head section 232 and/or foot section 236 or the entire upper substructure 216.

It is understood that the invention is not confined to the particular construction and arrangement of parts herein illustrated and described, but embraces such modified forms thereof as come within the scope of the following claims. Thus, the invention encompasses all different versions that fall literally or equivalently within the scope of these claims.

The invention claimed is:

1. A safety bed for patients with physical and developmental disabilities, the safety bed comprising:

a) a bed frame of substantially rigid construction to prevent gaps from forming between the bed frame and a mattress positioned within the bed frame, the bed frame including a headboard, a footboard, and a pair of opposing side boards which interconnect the headboard and the footboard; and b) a mattress support frame that is connected to the pair of opposing side boards and disposed within the bed frame for supporting the mattress and for independently raising and lowering the mattress within the bed frame in the absence of any corresponding vertical movement on the part of the headboard, footboard and pair of opposing side boards, wherein the headboard and footboard extend below the mattress; and wherein the mattress is in compressive contact within the bed frame such that there are no gaps between the mattress and the bed frame.

2. The safety bed of claim 1 further wherein the bed frame further comprises at least one pair of rotatable guard members each of the guard members being disposed on an opposing lateral side of the bed frame, the guard members being sized to occupy the entirety of the lateral space between the footboard and the headboard such that there are no gaps there between.

3. The safety bed of claim 2 wherein the rotatable guard members are removable.

4. The safety bed of claim 2 wherein the guard members include at least one locking member for engagement of the guard members with the bed frame.

5. The safety bed of claim 2 wherein the guard members include at least one transparent window disposed between the upper and lower ends of the guard members.

6. The safety bed of claim 1 wherein the mattress support frame includes mounting brackets to connect the mattress support frame to the pair of opposing side boards.

7. The safety bed of claim 1 wherein the mattress support frame includes support brackets, a lower substructure fixed on the support brackets, and an elevating upper substructure fixed to the lower substructure.

8. The safety bed of claim 7 further comprising at least two telescoping columns to affix the elevating upper substructure to the fixed lower substructure.

9. The safety bed of claim 6 wherein the mattress support frame includes a motor for raising the elevating upper substructure in relation to the fixed lower substructure.

10. The safety bed of claim 6 further comprising a remote control for operating the elevating upper substructure.

11. The safety bed of claim 1 wherein the mattress support structure includes articulating joints forming a head section, a thigh section, and a foot section.

12. A safety bed for patients with physical and developmental disabilities, the safety bed comprising:

a) a bed frame of substantially rigid construction to prevent gaps from forming between the bed frame and a mattress positioned within the bed frame, the bed frame including a headboard, a footboard, and a pair of opposing side boards which interconnect the headboard and the footboard;

b) a mattress support frame that is connected to the pair of opposing side boards and disposed within the bed frame for supporting the mattress and for independently raising and lowering the mattress within the bed frame in the absence of any corresponding vertical movement on the part of the headboard, footboard and pair of opposing side boards, wherein the headboard and footboard extend below the mattress; and wherein the mattress is in compressive contact within the bed frame such that there are no gaps between the mattress and the bed frame; and c) at least one pair of rotatable guard members each of the guard members being disposed on an opposing lateral side of the bed frame, the guard members being sized to occupy the entirety of the lateral space between the footboard and the headboard such that there are no gaps there between.

13. The safety bed of claim 12 wherein the rotatable guard members are removable.

14. The safety bed of claim 12 wherein the guard members include at least one locking member for engagement of the guard members with the bed frame.

15. The safety bed of claim 12 wherein the guard members include at least one transparent window disposed between the upper and lower ends of the guard members.

16. The safety bed of claim 12 wherein the mattress support frame includes mounting brackets to connect the mattress support frame to the pair of opposing side boards.

17. The safety bed of claim 12 wherein the mattress support frame includes support brackets, a lower substructure fixed on the support brackets, and an elevating upper substructure fixed to the lower substructure.

18. The safety bed of claim 17 further comprising at least two telescoping columns to affix the elevating upper substructure to the fixed lower substructure and wherein the mattress support frame includes a motor for raising the elevating upper substructure in relation to the fixed lower substructure.

19. The safety bed of claim 17 further comprising a remote control for operating the elevating upper substructure.

* * * * *